US006257474B1

(12) United States Patent
Jones et al.

(10) Patent No.: US 6,257,474 B1
(45) Date of Patent: Jul. 10, 2001

(54) AMPOULE OPENER

(76) Inventors: Don R. Jones, 434 Fairview Dr. #, Alum Creek, WV (US) 25177; Jeffrey B. Coulter, 732 N. Hills Dr., Charleston, WV (US) 25312

( * ) Notice: Subject to any disclaimer, the term of this patent is extended or adjusted under 35 U.S.C. 154(b) by 0 days.

(21) Appl. No.: 09/488,000

(22) Filed: Jan. 20, 2000

Related U.S. Application Data

(60) Provisional application No. 60/137,729, filed on Jun. 7, 1999.

(51) Int. Cl.[7] ..... B26F 3/00
(52) U.S. Cl. ..... 225/97; 225/103
(58) Field of Search ..... 30/114; 225/93, 225/103, 96.5, 96, 97; 241/99; 83/100, 80, 944

(56) References Cited

U.S. PATENT DOCUMENTS

| | | | | |
|---|---|---|---|---|
| D. 291,489 | | 8/1987 | Dudnyk . | |
| 2,359,644 | * | 10/1944 | Hoey | 49/52 |
| 2,488,956 | | 11/1949 | Yeskett . | |
| 2,503,517 | | 4/1950 | Sirica . | |
| 2,515,020 | | 7/1950 | Scott . | |
| 2,977,014 | * | 3/1961 | Kock | 215/12 |
| 3,154,230 | | 10/1964 | Langloys . | |
| 3,380,636 | | 4/1968 | Ushkow et al. . | |
| 3,450,319 | | 6/1969 | Ray et al. . | |
| 3,921,459 | * | 11/1975 | Willett | 73/425.2 |
| 4,405,067 | * | 9/1983 | Caron | 225/93 |
| 4,417,679 | | 11/1983 | Shields . | |
| 4,506,817 | | 3/1985 | Parker . | |
| 4,637,139 | | 1/1987 | Chen . | |
| 4,896,649 | * | 1/1990 | Rabenecker | 125/96.5 |
| 5,129,566 | | 7/1992 | Ogden et al. . | |
| 5,138,124 | * | 8/1992 | Kirk et al. | 219/68 |
| 5,651,296 | * | 7/1997 | Halm et al. | 83/451 |

FOREIGN PATENT DOCUMENTS 2315348 10/1974 (DE) .

* cited by examiner

*Primary Examiner*—Rinaldi I. Rada
*Assistant Examiner*—Omar Flores-Sánchez
(74) *Attorney, Agent, or Firm*—Richard C. Litman

(57) ABSTRACT

An ampoule opener for opening a glass ampoule containing a medication. The ampoule opener has a transparent, cylindrical container removably attached to an annular metal base. A rubber flap member is attached to the inner edge of the base. The flap member is divided into flaps by one or more slits. A pair of scoring assemblies are attached to the bottom portion of the base. Each scoring assembly has a blade attached to a spring and a finger grip. The top of the ampoule to be opened is inserted through the flap member so that the blades align with the ampoule neck. The finger grips are compressed to engage the blades with the ampoule, and the ampoule is rotated to score the neck. The finger grips are then released, and the flaps hold the ampoule while the neck is snapped. The ampoule top is secured by the rubber flaps until the top is pushed into the container by the insertion of the next ampoule. The container holds a plurality of ampoule tops.

17 Claims, 4 Drawing Sheets

AMPOULE OPENER

CROSS-REFERENCE TO RELATED APPLICATION

This application claims the benefit of U.S. Provisional Patent Application Serial No. 60/137,729, filed Jun. 7, 1999.

BACKGROUND OF THE INVENTION

1. Field of the Invention

The present invention relates generally to ampoule openers. More specifically, the invention is a hand tool for safely opening pharmaceutical containing ampoules.

2. Description of Related Art

Injectable medications and other liquid pharmaceuticals are increasingly being packaged in ampoules (also known as ampules or ampuls). The typical ampoule has a cylindrical body, a substantially conical tip, and a narrow neck joining the tip to the body. The tip is hermetically sealed after the ampoule is filled. Ampoules hold an individual dose of a medication and help to prevent errors by health care workers, such as under- or over-dosing. The ampoule also assures sterility of the medication, since it is used for only one patient.

Most ampoules today are pre-scored around the neck by the manufacturer. Ordinarily the ampoule is opened by holding the body in one hand and snapping the tip off the body with the other hand. Pre-scored ampoules have several disadvantages. Pre-scored ampoules are not given a deep, narrow score, as such scoring would make the ampoule too delicate to withstand shipping and handling. Ampoules with deep, narrow scores are also difficult to manufacture. The glass at the bottom of a deep, narrow score tends to remeld slightly if more than a few minutes passes between scoring and breaking. The result is that pre-scored ampoules by their nature are difficult to break.

Due to these problems, the broken edges of a pre-scored ampoule tend to be jagged and/or sharp. Glass chips often fly off in various directions when the ampoule is broken. Care must be taken to snap the ampoule neck away from the eyes. Glass chips may also fall into the medication.

Flying glass chips are an obvious danger to health workers and patients. Since the glass chips are small and transparent, they can be difficult to locate and remove from bedding, clothing, and the like. Such chips can cause uncomfortable cuts and scratches, even hours later.

Many health care workers protect themselves by wrapping an ampoule to be opened in a paper towel. Unfortunately, the paper towel makes it awkward to see and manipulate the ampoule. Wrapping and unwrapping the ampoule takes time. Injuries are still possible. Since the small tip cannot be seen and is difficult to feel through the paper, it is easily dropped and may be difficult to find and dispose of properly. The opened ampoule may also be dropped or spilled.

Gloves, such as latex examination gloves, may be worn to protect the hands. However, the broken edges of an ampoule are sharp enough to cut through standard gloves. Injury is still possible.

Glass chips in the medication typically fall to the bottom of the ampoule. The last drop or two of the medication therefore cannot be used. For a typical 1 mL or 2 mL ampoule, as much as one-eighth to one-quarter of the medication may have to be discarded due to glass chips. Since the ampoule contains an individually measured dose, often another ampoule must be opened to make up the difference. This provides a second opportunity for injury due to broken glass. Most of the contents of the second ampoule is discarded, which wastes expensive medication. The benefits of having a pre-measured, individual ampoule dose are lost.

U.S. Pat. No. 2,488,956 to V. J. Yeskett discloses an ampoule cutter having a cylindrical body portion with an elongated opening in the side. A file is secured parallel to the opening. After the ampoule is nicked on the file, the tip is inserted through an opening in one of the ends of the body portion. Bending the body of the ampoule breaks the tip, which then falls through a funnel-shaped opening into a receiver.

U.S. Pat. No. 2,503,517 to Sirica teaches a U-shaped ampoule neck cutter having a pair of jaws. One jaw has a V-shaped cutting edge to score the neck of an ampoule when the cutter is twisted. The cutting element may be sintered carbide, hard steel, carbaloy, tungsten carbide, etc.

U.S. Pat. No. 2,515,020 to M. E. Scott discloses an ampoule opener having a soft spring which engages the sharp point of an angular bort with the glass. The spring limits the cutting pressure that can be applied. The tip of the ampoule is then placed in a breaker hole to break the glass.

U.S. Pat. No. 4,417,679 to Shields discloses an ampoule opener having a head holder. The head holder has a hole with a cylindrical opening at one end for receiving at least part of the head of the ampoule. An annular flexible jacket extends from the end of the head holder. The outlet of the head holder is connected to a vacuum source, so that the particles formed by snapping the ampoule are inspired into the vacuum source.

U.S. Pat. No. 4,506,817 to Parker teaches a device for opening ampoules having a hollow cylindrical body. The peripheral wall has slits forming two halves which can flex relatively apart or together at an open end for entry or ejection respectively of an ampoule head. The slits extend parallel to the longitudinal axis of the body. The body has an inwardly-directed annular bead for breaking the neck. A cutter protrudes from the bead for cutting the neck. A plunger is provided to eject broken ampoule heads.

U.S. Pat. No. 4,637,139 to Chen discloses an ampoule cutter having a pair of half-cylindrical shells in which an ampoule is inserted.

None of the above inventions and patents, taken either singly or in combination, is seen to describe the instant invention as claimed.

SUMMARY OF THE INVENTION

The invention is an ampoule opener for opening a glass ampoule. The ampoule opener has a transparent, cylindrical container removably attached to a cylindrical metal base. A rubber flap member is attached to the inner edge of the base. The flap member is divided into flaps by one or more slits. A pair of scoring assemblies are attached to the middle portion of the base. Each scoring assembly has a blade attached to a spring and a finger grip. The top of the ampoule to be opened is inserted through the flap member so that the blades align with the ampoule neck. The finger grips are compressed to engage the blades with the ampoule, and the ampoule is rotated to score the neck. The finger grips are then released, and the flaps hold the ampoule while the neck is snapped. In an alternative embodiment of the invention, a transparent shield may be attached to the bottom of the base to help protect the user from glass chips. The ampoule top is secured by the rubber flaps, where it will be pushed into the container when the next ampoule is inserted into the flap member. The container is large enough to hold several ampoule tops.

Accordingly, it is a principal object of the invention to provide an ampoule opener having a transparent container, an annular base, a rubber flap member, and two scoring assemblies.

It is another object of the invention to provide an ampoule opener in which the ampoule can be scored and broken in a single location.

It is a further object of the invention to provide an ampoule opener having rubber flaps to secure the ampoule while the neck is scored and snapped.

Still another object of the invention is to provide an ampoule opener having a container which will hold several ampoule tops.

Another object of the invention is to provide an ampoule opener which will score an ampoule neck cleanly and secure the ampoule to break easily without jagged edges and with few or no glass chips.

Another object of the invention is to prevent injuries to health care workers and patients.

A further object of the invention is to avoid waste of medication and to save time for health care workers It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
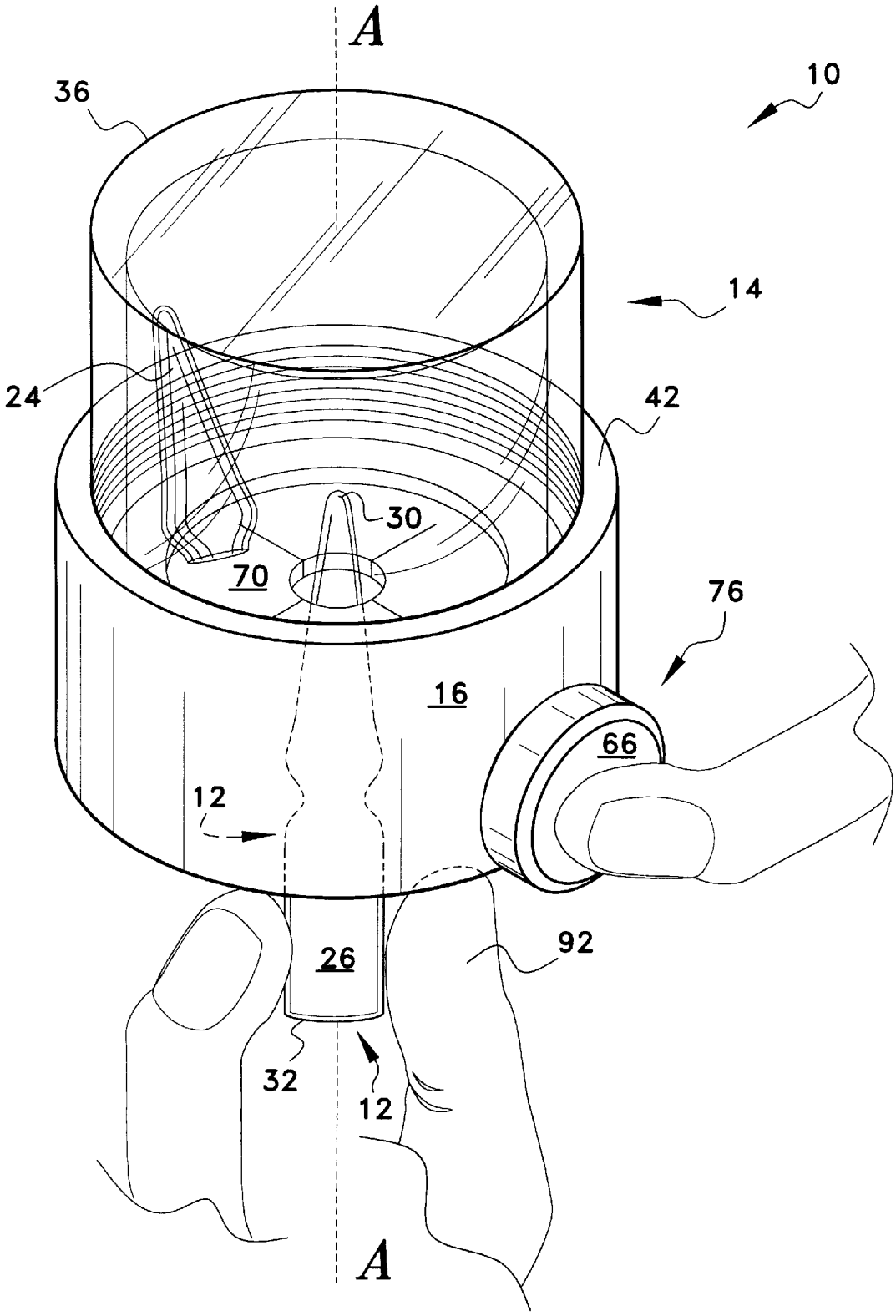
FIG. 1 is an environmental, perspective view of an ampoule opener according to the present invention, showing an ampoule partially inserted.

The present invention is an ampoule opener 10 for opening a glass ampoule 12. The ampoule opener 10 includes a transparent container 14, a base 16, and two scoring assemblies, generally 18. The typical ampoule 12 has a top 24 and a body 26. A neck 116 connects the top 24 and the body 26. The height of the ampoule 12 is from the distal end 30 of the top 24 to the bottom 32 of the body 26. The medication 34 (represented by ghost lines in FIG. 5) is contained in the body 26 of the ampoule.

Figure 2:
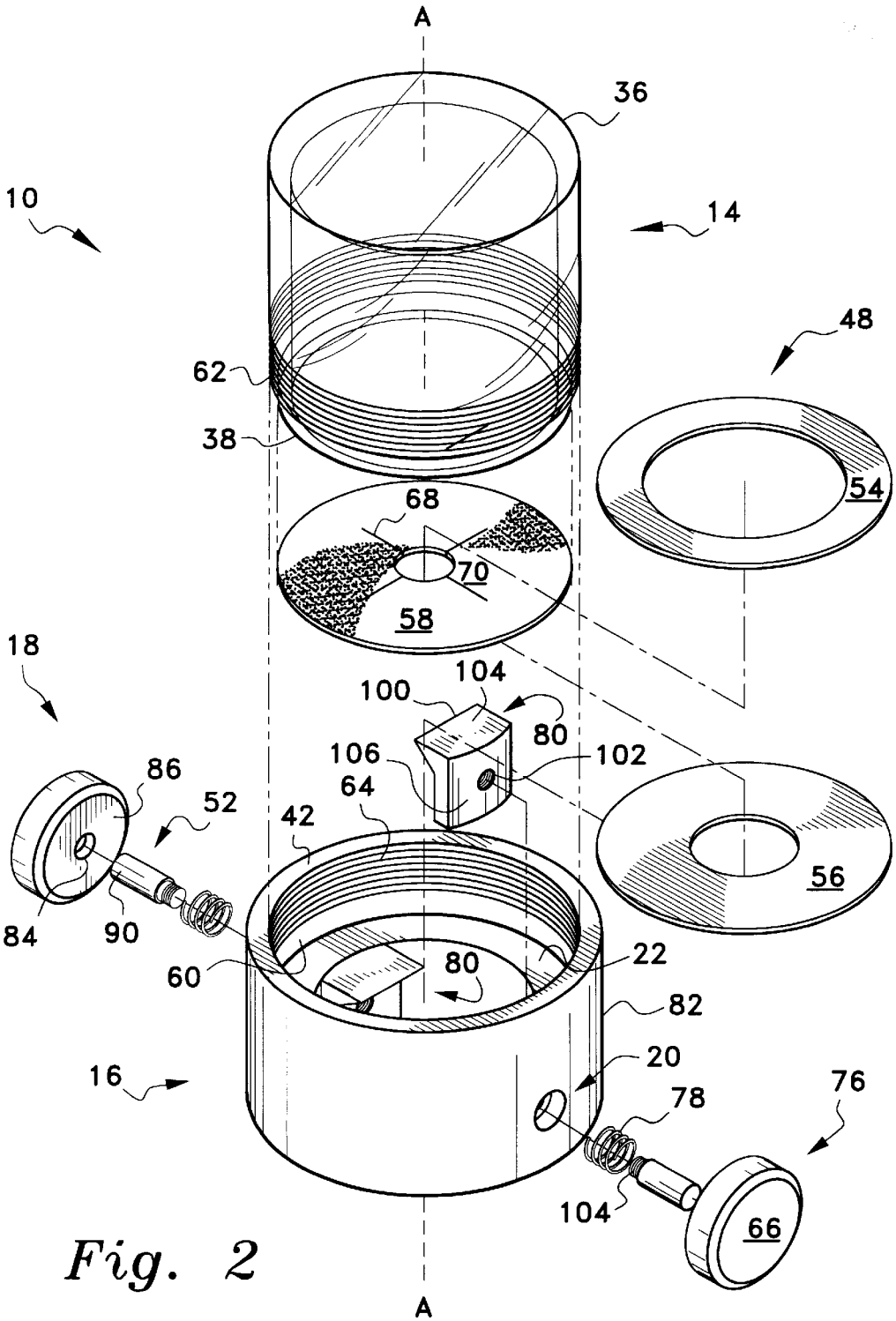
FIG. 2 is an exploded view of an ampoule opener.
Figure 5:
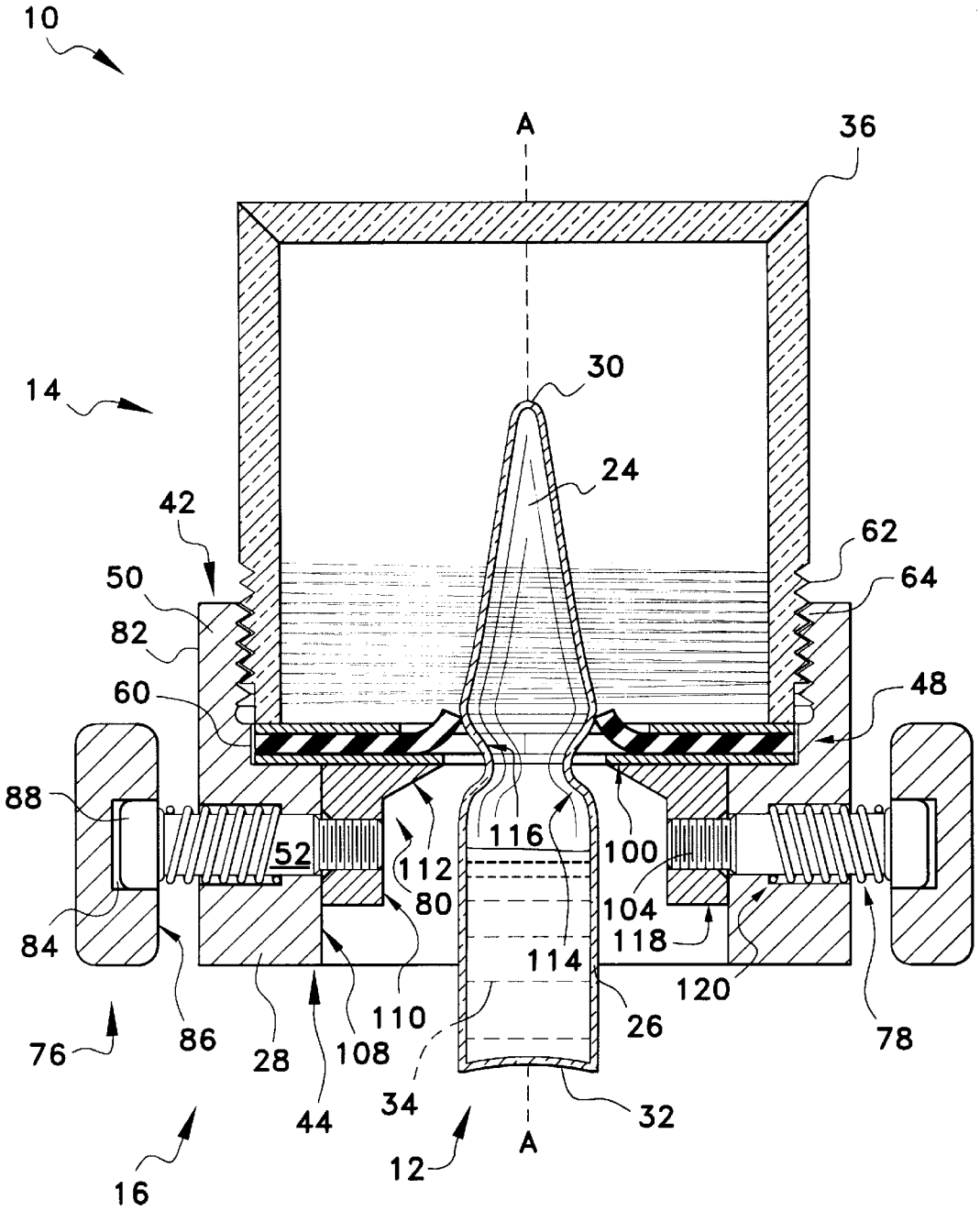
FIG. 5 is a cross-sectional, side view of an ampoule opener showing the blades engaged with the ampoule neck.

The container 14 has a top end 36 and a bottom end 38. See FIG. 2. The axis A of the container is shown in FIGS. 1–2 and 5. The container 14 is cylindrical or generally cylindrical in shape. The container 14 may be composed of any suitable lightweight, transparent material. Preferably the container 14 is composed of transparent plastic. Preferably the container 14 has a uniform or nearly uniform diameter from the top end 36 to the bottom end 38.

The container 14 contains the top 24 of the ampoule 12 after the ampoule 12 is opened. Preferably the container 14 is large enough to contain 3–8 ampoule tops, ideally about 5 ampoule tops 24. The outer diameter of the container 14 is preferably 1¾ inches. The height of the container 14 is preferably 1⅝ inches. If the container is too large, the ampoule opener 10 may be awkward to carry in a pocket and to handle during use.

The top end 36 of the container 14 is closed, while the bottom end 38 is open. Preferably the bottom end 38 is completely open, as shown in FIG. 2. This arrangement facilitates emptying accumulated ampoule tops 24 from the container 14. However, the bottom end 38 may have a small lip extending inward, if desired.

The base 16 is generally cylindrical. As shown in FIG. 5, when a radial cut is made through the ampoule opener 10, the base 16 is shown to be generally L-shaped in structure, having a short upper base portion 50 for engaging with the container 14 and a lower base portion 28, which is approximately twice as wide as the upper base portion 50 and has a pair of diametrically opposite rim apertures, generally 20, disposed therethrough, each for receiving the elongated rod 52 of a scoring assembly 18.

The two scoring assemblies 18 of the ampoule opener 10 are attached to the base 16 directly opposite each other. The scoring assemblies 18 are centrally located on the lower base portion 28 of the base 16. This location avoids interference with removal of the container 14 and allows the ampoule 12 to be easily seen while it is being scored and opened. This location also avoids contamination of the scoring assemblies 18 by any medication left behind in the ampoule tops 24. The lower base portion 28 of the L-shaped rim of the base 16 defines a shelf 22 at its uppermost extent, best seen in FIG. 2, for supporting a flap assembly 48. The flap assembly 48 is designed for holding and receiving an ampoule 12 as shown in FIGS. 1 and 5, the shelf 22 providing a support surface for fixedly attaching the flap assembly 48 to the base 16.

The flap assembly 48 comprises an upper steel washer 54, a lower steel washer 56, and a planar neoprene diaphragm 58 disposed therebetween. The upper washer 54 preferably has an outer diameter of 1.680" and an inner diameter of 0.768" with a thickness of 0.032". The lower washer 56 preferably has an outer diameter of 1.680", an inner diameter of 0.500", and a thickness of 0.032". The neoprene diaphragm 58 is preferably 1 21/32" (outer diameter) and 0.342" (inner diameter), with a thickness of 1/16". The dimensions herein related correspond to the preferred embodiment of the invention, but this specification embraces any other suitable dimensions which may be employed. The base 16 has a top end 42 and an opposite bottom end 44, as shown in FIG. 5. The upper 50 and lower 28 portions of the base also each have an inner edge. The base is composed of metal. The metal is preferably stainless steel, but may be aluminum or other any other suitable material.

Referring to both FIGS. 2 and 5, it can be seen that the smooth lower inner edge 60 of the upper base portion 50 approximately coincides with the outer edge of the flap assembly 48; in alternative embodiments of the invention, the outer edge of the flap assembly 48 may be fixedly attached to the smooth lower inner edge 60, which is parallel to the central axis A.

As best seen in FIGS. 2 and 5, the ampoule opener 10 includes removable attachment means for attaching the bottom end 38 of the container 14 to the upper portion 50 of the base 16. Preferably, the bottom end 38 of the container 14 has external threads 62, and the upper portion 50 of the base 16 has mating internal threads 64. The threads, 62 and 64, removably attach the container 14 to the base 16.

A variety of other attachment means may be used. If the container 14 is flexible, a ridge-and-groove arrangement may be used so that the container 14 snaps onto or off of the base 16. The container 14 may have protruding tabs which slide and lock in corresponding slots on the base 16 when the container 14 is rotated. A pin lock may also be used.

Again, as seen in FIGS. 2 and 5, when the container 14 and the base 16 are screwed together, the flap assembly 48 extends radially inwardly from the inner edge 60 of the upper portion 50 of the base 16. Preferably, the flap assembly 48 is securely fixed to the shelf 22. The flap assembly may be attached with adhesive or by any other means, or the lower inner edge 60 may have a groove into which the perimeter of the flap assembly 48 snaps. The flap assembly 48 may also be removable for easy cleaning or sanitization. In the preferred embodiment of the invention, the individual components of the flap assembly 48 (washer 54, diaphragm 58, and washer 56) are adhesively held together by any conventional means well known in the art, but, in alternative embodiments, may be held together by the mechanical pressure created between the container 14 and the bottom 16 when engaged, the flap assembly 48 being sandwiched therebetween. This arrangement also allows for disassembly, cleaning, and sanitization.

Figure 3:
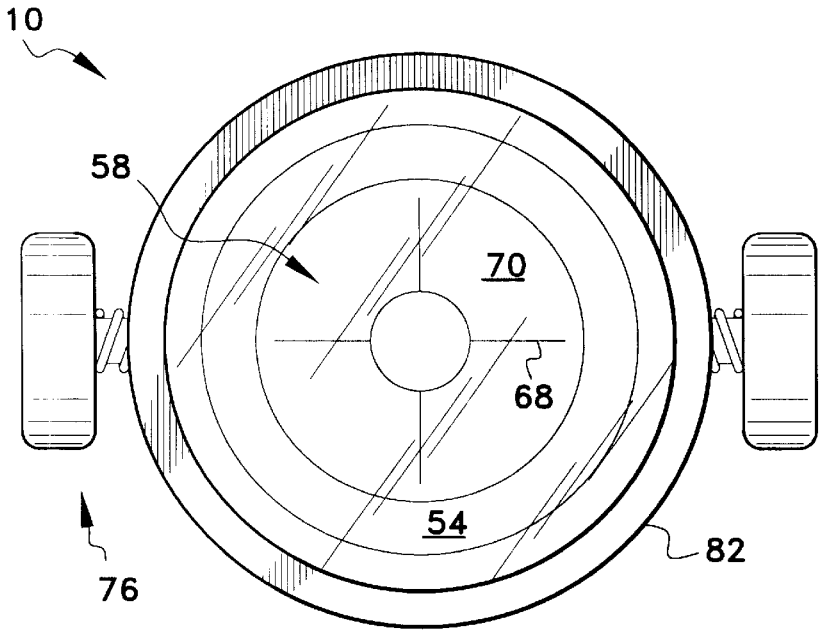
FIG. 3 is a top plan view of an ampoule opener, showing the flap member and finger grips.
Figure 4:
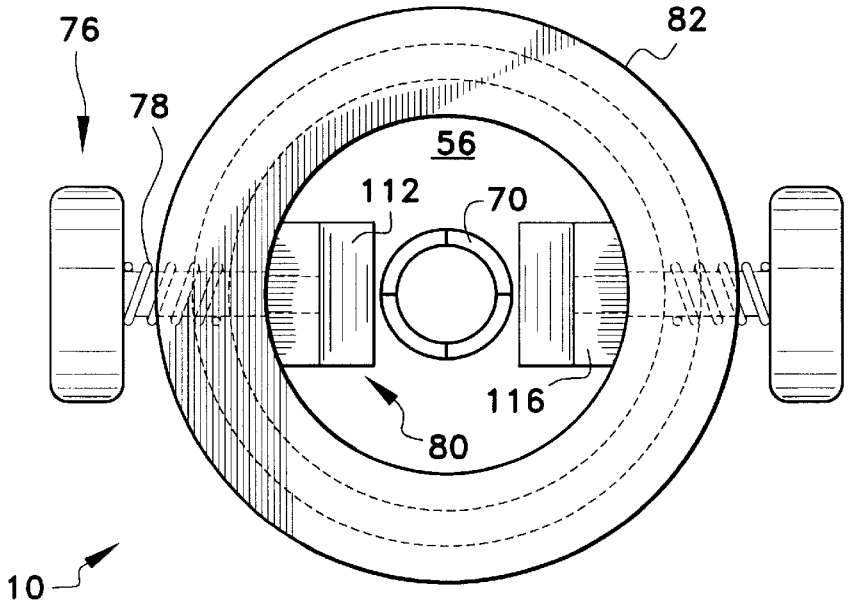
FIG. 4 is a bottom view of an ampoule opener, showing the scoring assemblies.

The flap assembly 48 is circular or generally circular, as shown in FIGS. 3 and 4. The flap assembly 48 is planar or generally planar. The plane is oriented perpendicular to the axis A of the container 14. The flap assembly 48 holds the ampoule top 24 while the ampoule 12 is being scored and broken, and keeps broken ampoule tops 12 safely inside the container 14 until the container 14 is removed for emptying.

The planar diaphragm 58 of the flap assembly 48 has at least one, but preferably two cuts or slits, each slit generally 68, which divides the diaphragm 58 into at least two flaps, each generally 70. See FIGS. 3 and 4. The flap assembly 48 is preferably prepared by making four cuts 68 through the neoprene diaphragm 58, each cut extending outwardly from the central axis A, and each being in equidistant, spaced apart relationship. An opening for receiving the top 24 of an ampoule 12 is formed by removing a circular portion having a preferable radius of 0.176" from the axis A of the opener 10. After removing the central circular portion, the remaining cuts 68 correspond in length to approximately one half the distance between the outer diameter of the diaphragm 58 and the inner diameter formed by removal of the circular portion. The flaps 70 may be composed of natural or synthetic rubber.

The opening formed by the slit or slits 68 is adapted to receive the top 24 of the ampoule 12. The ampoule top 24 pushes the flaps 70 aside, as shown in FIGS. 1 and 5. Once inserted between the flaps 70, the ampoule 12 extends parallel or generally parallel to the axis A of the opener 10. The flap assembly 48 automatically adjusts to differently sized ampoules 12.

After an ampoule top 24 is snapped off, the ampoule top 24 is preferably simply left between the flaps 70. The next ampoule 12 inserted will push the ampoule top 24 through into the container 14. Alternatively, the user may turn the ampoule opener 10 over and rap the container 14 sharply so that the ampoule top 24 falls into the container 14.

In an alternative embodiment of the invention, the flaps 70 may cover the entire area of the circular aperture of the base 16. This prevents any possibility of glass pieces or contaminants from the ampoule tops 24 falling through the flaps 70. However, as noted previously, in the preferred embodiment the tip of each flap 70 is removed to form a small hole in the center of the flap diaphragm 58 to allow the distal end 30 of the ampoule 12 to be inserted more easily.

The optimal slit 68 length of the flap assembly 48 depends on the typical ampoule 12 size, the thickness of the diaphragm 58, and the number of flaps 70. The slits 68 must be long enough for ampoule tops 24 of the largest size typically encountered to pass through the opening. If the slit 68 length is too short, the ampoule top 24 will be difficult to push through the opening into the container 14. If the slits 68 are too long, the flaps 70 will not hold the ampoule 12 securely while the ampoule neck is scored and snapped.

The thickness of the diaphragm 58 also affects the resistance provided by the flap assembly 48 as an ampoule 12 is pushed through it. If the diaphragm 58 is too thin, the ampoule top 24 will not be gripped securely. If the diaphragm 58 is too thick, substantial force will be required to push the ampoule 12 through into the container 14. For longer slit 68 lengths, greater rubber thickness may be required to provide the necessary gripping force. Four flaps 70 conform easily to the shape of the ampoule top 24 and help to hold the ampoule 12 firmly. A single slit 68 forming two flaps 70 may be sufficient if the rubber is fairly flexible. Preferably there are no more than eight flaps 70. A large number of flaps 70 may impede gripping ability and also reduce durability.

Each scoring assembly 18 includes a finger grip, generally 76, a spring 78, and a blade 80. Each finger grip 76 is located near the outer edge 82 of the base 16. The finger grips 76 are preferably located exterior to the base 16. Alternatively, the finger grips 76 may extend through the apertures 20 in the outer edge 82 of the base 16.

The finger grips 76 are preferably composed of stainless steel, and may be roughened or contoured to make them easy to hold. Alternatively they may be made of aluminum, titanium or any suitably strong and durable substance. Each finger grip 76 is generally circular in appearance, having rounded corners and a recess 84 centrally located on their respective inner faces 86 for the reception of the slotted head 88 of a scoring assembly rod 52, preferably as shown in FIG. 5. However, in the alternative embodiment of the assembly 18, shown in FIG. 2, the head 88 may be absent, substituted by an essentially cylindrically shaped end portion 90, which may be fixedly attached to its corresponding finger grip 76.

The scoring assembly 18 may have several different configurations. In a preferred embodiment, each rod 52 has a blade end and a grip end. The rod 52 is perpendicular to the axis A. The rod 52 may screw into the blade 80, as shown in FIGS. 2 and 5, or may extend straight out from the blade 80. The grip end is attached to the finger grip 76. Preferably, the head 88 is a steel slotted head such as commonly known in the art, attached thereon for improving attachment to the finger grip; in the preferred embodiment of the invention, the rod has a diameter of 3/16", is 0.5" long and further comprises a self locking strip.

In alternative embodiments of the invention, the inner surface 86 of the finger grips 76 may be concave to follow the cylindrical surface of the base 16. Additionally, the outer surface 66 of the finger grips 76 may be concave to reduce the bulk of the ampoule opener 10. The outer surface 66 may also be configured to prevent the user's fingers 92 from slipping off. And so the outer surface 66 may be contoured for the index finger and thumb respectively or have any shape suitable for the purpose at hand.

Each blade 80 scores the neck of the ampoule 12. The blade 80 may be composed of tungsten carbide, hardened steel, or other materials suitable for cutting glass or other similar substances. The blade 80 may be triangular, V-shaped, or any other suitable shape or size but is preferably substantially boot-shaped in cross section, as shown in FIG. 5, defining a cutting edge 100 at its superior medial portion with respect to the axis A when the blade 80 is in position for use. In this same position, the side of the boot-shaped blade 80 facing inward defines two surfaces, a lower inner blade surface 110, which is planar and parallel to the main axis A, and an upper inner blade surface 112 at an angle to the lower surface 110 substantially mirroring the shape the lower part neck portion 114 of an ampoule 12. Surface 112 further defines the cutting edge as discussed above. As shown in the exploded view of FIG. 2 and in FIG. 5, the blade 80 is also shaped so that its top surface 104 is planar so as closely abut the lower washer 56 when in place, and its lateral surface 106 is curved so as to parallel and conform to the curved inner surface 108 of the base 16.

FIG. 4 provides a view of the preferred arrangement of the blades 80 with reference to the rod assemblies 18, the flap assemblies 48, and the container 18 seen in ghost lines. FIG. 3, a top view, reveals that the blades 80 are hidden from a user looking downwards from above when in the resting position. The bottom surface 118 of the blades 80 are also flat.

Each blade 80 has an aperture 102, best seen in FIG. 2, disposed in its central portion for receiving the blunt end 104 of a scoring assembly rod 52, the rod impelling the blade against the ampoule. The spring 60 impels or biases the blade 80 of its corresponding scoring assembly 18 in a radially outward direction, along the length of the scoring assembly 18. Both rim apertures 20 are suitably formed to receive and support the scoring assemblies 18, and nested within each are a portion of the corresponding scoring assembly rod 52 and its associated spring 78. And so a portion of the length of each aperture 20 accommodates both the rod 52 and the spring 78, and a portion accommodates the rod 52 alone—the abrupt change in diameters between these two portions defining a shelf or rim 120 against which the spring 78 may push, enabling it to impel the finger grip 76 to which it is attached outward.

The blades 80 may score the ampoule neck 116 at any convenient location. Ideally, the blades 80 score the ampoule neck 116 along the pre-scored breakage line, to avoid any possibility of the ampoule neck breaking in two places.

The spring 78 is preferably a coil spring surrounding the rod 52 close to the finger grip 76. Ideally, the coil spring 78 is located around the rod 52 and nested neatly within the rim apertures 20. As discussed, in the preferred embodiment, a portion of each aperture 20 is formed so as to receive and closely abut the rod 52 with its associated spring 76; however, this specification embraces any means for urging the blades 80 against the ampoule 12 such as commonly known in the art and in conventional usage. A tube (not shown) also may surround the rod 52. The coil spring 78 may be compressed between the finger grip 76 and the tube. In the preferred embodiment of the invention, the springs 78 each have an outer diameter of 0.240" and a free length of 0.44".

Finger pressure on the finger grips 76 compresses the spring 78 and moves the rod 52 through the rim apertures 20 radially inward toward the axis A. The blades 80 are thereby pressed against the ampoule 12, the edge 100 of the blade 80 contacting and cutting the neck 116 of the ampoule 12. When the ampoule 12 is turned, the blades 62 score the ampoule neck 116. The duplicate scoring assemblies make it possible to score completely around the neck in only ½ turn. The blades 80 are located directly opposite one another and score the ampoule 12 in the same line. This allows for quick, easy, effective scoring, leading to an ampoule 12 which snaps easily with almost no glass chips released.

In an alternative embodiment of the invention, the ampoule opener may also include a shield (not shown) having a top end which attaches to the bottom end 44 of the base 16. The shield may be cylindrical, conical, or any of any suitable shape, dimensions or design, and may be transparent. The shield may be composed of the same transparent plastic as the container 14. The transparent shield would allow the user to easily see the ampoule 12 and verify that it is positioned correctly. The shield may also protects the user from any glass chips released when the ampoule 12 is broken. Since the shield would extend below the finger grips 76, the shield also makes the ampoule opener 10 easier to grasp and hold steadily. The shield would also provides leverage when the ampoule neck is snapped. The height of the shield would preferably range from about ⅓ to about ⅔ of the height of a typical ampoule 12. A suitable height for the shield is about 1–2 centimeters, for a total height of the ampoule opener of about 4–6 centimeters.

The shield may attach to the bottom end 44 of the base 16 in several ways. The shield would be preferably removably attached, so that the entire ampoule opener 10 can be disassembled if necessary for cleaning. However, the shield may be fixedly attached, by an adhesive or other mean, including by threaded attachment to the base 16. If the shield has a notch for the rod 52, the top end of the shield may removably attach by snapping it into place. A ridge-and-groove arrangement may be used. For example, a ridge on the shield may snap into a groove inside the base 16. Alternatively, a pin lock or similar arrangements may be used, as for the attachment of the container 14 to the base 16.

The ampoule opener 10 allows for fast, easy breakage of ampoule tops 24, with a minimal number of steps. The ampoule 12 is simply inserted through the flap assembly 48, the finger grips 76 are compressed, and the ampoule 12 is turned. Next, the finger grips 76 are released and the ampoule 12 is tilted to snap the neck 116. The ampoule 12 is scored and broken in a single location. This contrasts with the prior art, in which different locations are often used for scoring and breaking the ampoule 12.

After breaking the ampoule 12, the ampoule top 24 can simply be left in the flap assembly 48 of the ampoule opener 10. The ampoule top 24 will be pushed out of the way by the next ampoule 12. Disposal of the ampoule top 24 can wait until after the medication is given to the patient, or until another convenient time. Ampoule tops 24 can therefore be broken without a hazardous waste disposal unit nearby. This saves time, particularly in emergency situations. Health care workers can avoid touching the ampoule top 24 at all while scoring or breaking the ampoule 12 or disposing of the ampoule top 24.

The clean break provided by the ampoule opener 10 is much less likely to produce jagged edges and glass chips than typical breaking methods. This prevents injury to health care workers and patients. Since fewer glass chips are produced, virtually no glass chips fall into the medication. Waste of medication is avoided, and additional ampoules do not have to be opened.

It is to be understood that the present invention is not limited to the sole embodiments described above, but encompasses any and all embodiments within the scope of the following claims.

We claim:

1. An ampoule opener for opening a glass ampoule, the ampoule having a top, a neck, and a height, the ampoule opener comprising:

(a) a container having a top end, a bottom end, and an axis, said container being generally cylindrical and transparent, said top end being closed, said bottom end being open, said container being adapted to contain the top of an ampoule after the ampoule is opened;

(b) a base having a top portion, a bottom portion, an inner edge, and an outer edge, said base being generally annular and including a pair of diametrically opposite apertures disposed through the bottom portion;

(c) attachment means for removably attaching said bottom end of said container to said top portion of said base;

(d) a flap assembly attached to and extending radially inwardly from the inner edge of said base, said flap assembly being generally planar and perpendicular to the axis of said container;

said flap assembly comprising a diaphragm, said diaphragm having at least one slit, said slit dividing said diaphragm into at least one flap, said slit being adapted to receive the top of the ampoule with the ampoule extending generally parallel to said axis of said container;

(e) a pair of scoring assemblies connected to said base through the pair of diametrically opposite apertures disposed through said bottom portion of said base;

each of said scoring assemblies including a finger grip, a spring, a rod, and a blade;

each said finger grip being located near said outer edge of said base, each said finger grip being connected to a said blade by a scoring assembly rod;

said spring biasing said blade of its corresponding said scoring assembly in a radially outward direction, each said blade being adapted to score the neck of the ampoule.

2. The ampoule opener according to claim 1, wherein said bottom end of said container has external threads, said top portion of said base has internal threads, and said external and said internal threads are arranged so as to allow said container to be removably attached to said base.

3. The ampoule opener according to claim 1, wherein said diaphragm has four slits, and said slits divide said diaphragm into four flaps.

4. The ampoule opener according to claim 1, wherein said container is composed of a polymeric material.

5. The ampoule opener according to claim 1, wherein each said finger grip has a concave outer surface.

6. The ampoule opener according to claim 1, wherein said flap assembly is generally circular.

7. The ampoule opener according to claim 1, wherein said container and said base each have an outer diameter, and said outer diameter of said container is approximately equal to said outer diameter of said base.

8. The ampoule opener according to claim 1, wherein each of said scoring assemblies comprises a rod, each said rod has a blade end and a grip end, each said blade end is attached to one of said blades, each said grip end is attached to one of said finger grips, and each said blade has a cutting edge for scoring the ampoule.

9. The ampoule opener according to claim 1, wherein said base is made of a material selected from the group consisting of stainless steel, aluminum, and titanium.

10. The ampoule opener according to claim 1, wherein each said blade is made of tungsten carbide, said blade being generally boot-shaped in cross-section and having a cutting edge for scoring an ampoule.

11. The ampoule opener according to claim 1, wherein each said spring is a coil spring, each said coil spring connecting to its said corresponding scoring rod to impel it in a radial direction outward from said base.

12. The ampoule opener according to claim 11, wherein each said coil spring is partially nested within said base of said opener.

13. The ampoule opener according to claim 1, wherein said flap assembly comprises an upper washer and a lower washer with said diaphragm disposed therebetween, said diaphragm being composed of a flexible material, said upper and lower washers and said diaphragm being arranged in a layered relationship so as to cooperatively receive the top of the ampoule therethrough, said upper and lower washers being dimensioned so as to allow the top of the ampoule to be received into said container, each said blade closely abutting said lower washer when said flap assembly is readied for use; said diaphragm being pierced so as to receive and reversibly hold the ampoule to allow the ampoule to be scored.

14. The ampoule opener according to claim 13, wherein said flap assembly is fixedly attached to said ampoule opener base.

15. The ampoule opener according to claim 13, wherein said flap assembly is reversibly attachable to said ampoule opener base.

16. The ampoule opener according to claim 15, wherein said diaphragm is fixedly attached to said upper washer.

17. The ampoule opener according to claim 15, wherein said diaphragm is fixedly attached to said lower washer.

* * * * *